United States Patent [19]

Stolarz

[11] Patent Number: 4,658,467

[45] Date of Patent: Apr. 21, 1987

[54] LUGGAGE HANDLE

[75] Inventor: Edward Stolarz, Yorktown Heights, N.Y.

[73] Assignee: Homa Locks, Inc., Danbury, Conn.

[21] Appl. No.: 815,939

[22] Filed: Jan. 3, 1986

[51] Int. Cl.[4] ..... A45C 13/00

[52] U.S. Cl. ..... 16/126; 190/115

[58] Field of Search ..... 16/225, 114 R, 110 R, 16/119, 126, DIG. 18, DIG. 24, DIG. 41; 190/115–117

[56] References Cited

U.S. PATENT DOCUMENTS 1,004,683 10/1911 Pritchard et al. ..... 16/126

2,613,771 10/1952 Levine ..... 16/111 R 3,398,425 8/1968 Croxson et al. ..... 16/225

4,585,134 4/1986 Miyagi et al. ..... 190/115

*Primary Examiner*—Donald R. Schran

*Assistant Examiner*—James L. Wolfe

*Attorney, Agent, or Firm*—Bauer & Amer

[57] ABSTRACT

A luggage handle formed of a pair of identical halves, each having a vertical leg and horizontal arm. The halves are assembled by slidably abutting the horizontal arms in overlapping arrangement so that the tip end of one is inserted in a cavity in the vertical leg of the other. The horizontal arms may be inserted through a surrounding sleeve and provided with cooperable interengagements.

3 Claims, 5 Drawing Figures

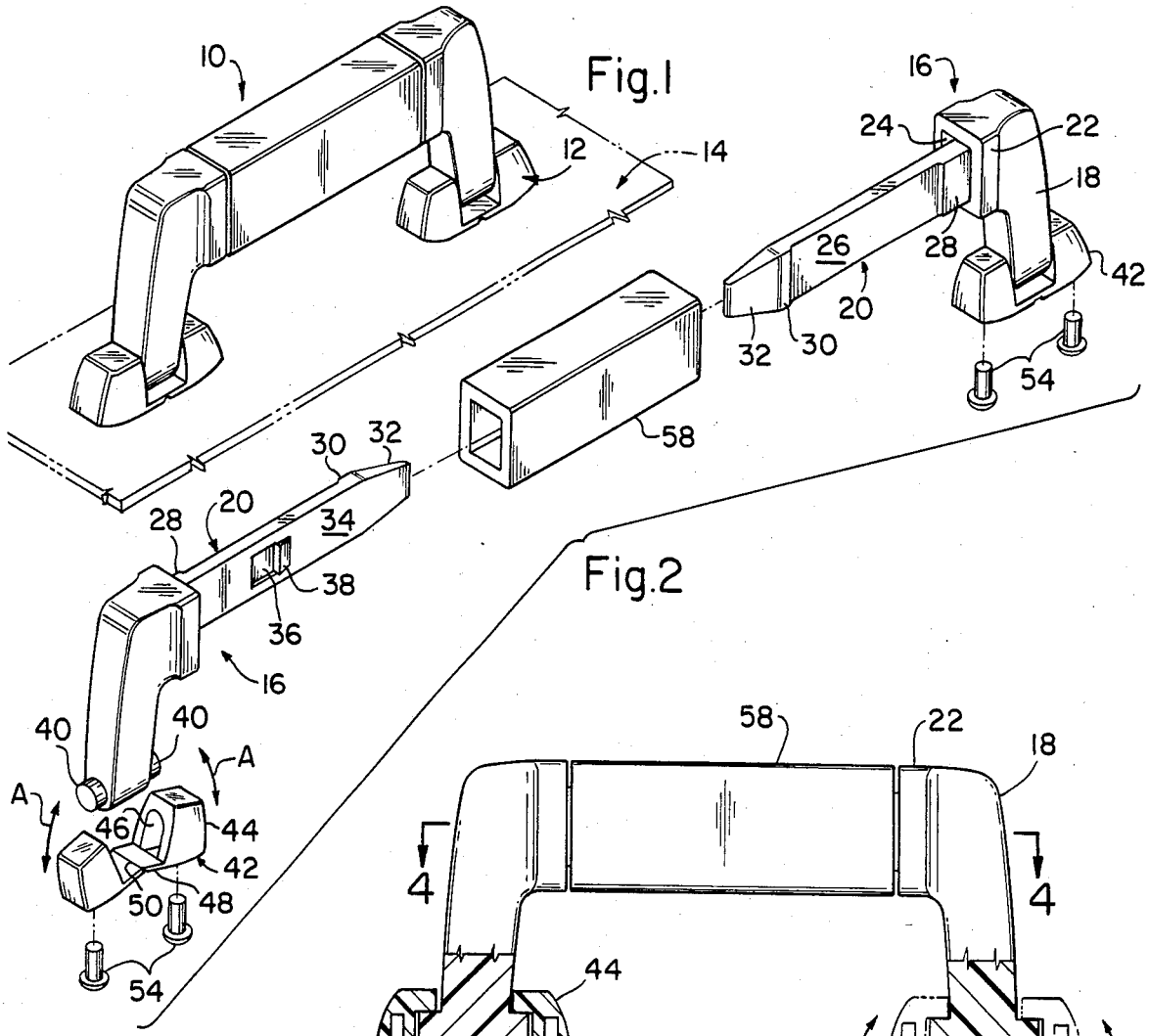
Fig.1
Fig.2
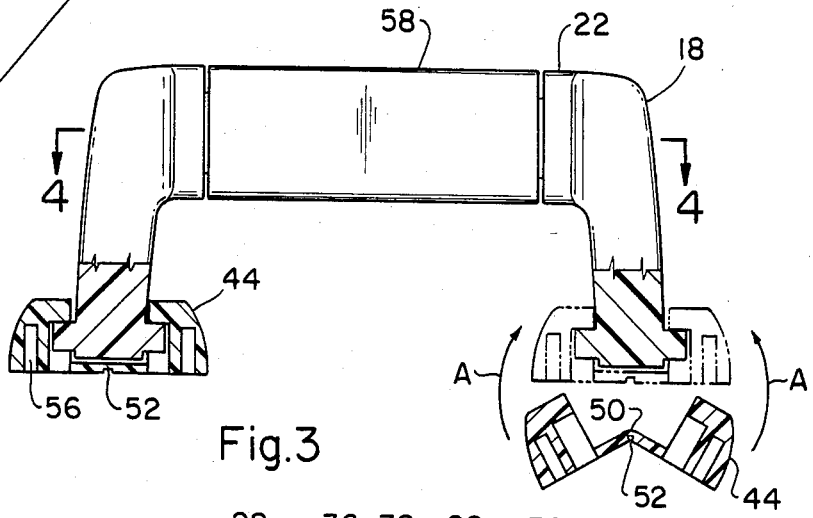
Fig.3
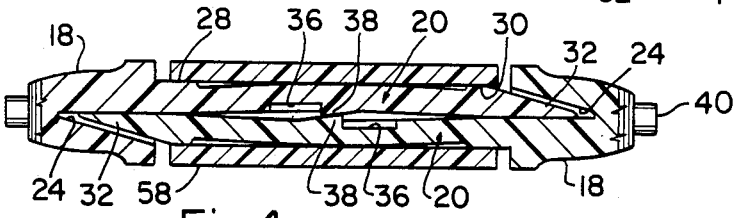
Fig.4a
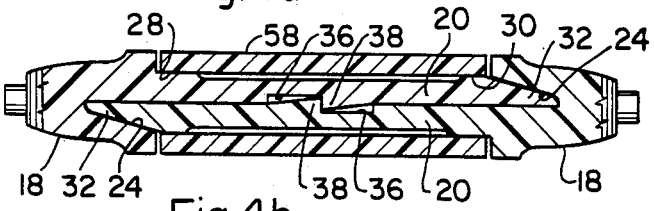
Fig.4b

LUGGAGE HANDLE

BACKGROUND OF THE INVENTION

The present invention relates to luggage handles and in particular to the construction of a simple and inexpensive handle for hand luggage such as for attache and suit-cases.

Plastic handles have come into wide use, not only on inexpensive fabric and plastic throw-away luggage, but even on the more expensive leather luggage. In general, plastic handles can be molded in various shapes, sizes and colors so as to be a decorative adjunct to the hand luggage itself. The problem, however, lies in the fact that in molding plastic handles, it is generally almost impossible and extremely complex to mix colors and designs within a single handle itself. For example, it is sometimes preferable to have a molded handle in which the grip portion is embossed so as to simulate leather while the remaining portion of the handle is of a different texture.

Another problem lies in the difficulty of molding complete U-shaped handles with means for pivotally attaching the handle to the case. In general, the complexity of the necessary mold gives rise to high costs both for parts and labor.

It is the object of the present invention to provide a luggage handle which is simple and inexpensive to fabricate and which can provide for a variety for appearances, textures, and colors in a most inexpensive way.

The foregoing objects, together with other objects and advantages will be apparent from the following disclosure.

SUMMARY OF THE INVENTION

In accordance with the present invention, a luggage handle is provided, formed of a pair of identical handle halves, each having a vertical leg and a horizontal arm disposed at right angles to each other. The handle halves are arranged in opposition to each other so that the horizontal arms abuttingly overlap along their length and their respective tip ends are seated within a cavity formed of the apex of the opposing handle half. The horizontal arms are provided with cooperative interlocking means which prevents their axial or longitudinal displacement once the handle halves are assembled.

In the foregoing manner, the handle is easily molded in two relatively inexpensive halves, each half being identical, thereby reducing the size of the mold as well as its complexity.

Preferably, the horizontal arms are covered by a sleeve which closely surrounds the arm and which can be formed so as to simulate any desirable texture or feel as well as imitate any desired material. The sleeve is a tubular member and thus easily molded or extruded. The horizontal arms are insertable into either end of the sleeve member so that the the interlocking means are biased in interengagment with each other and are held securely fast by the sleeve preventing lateral displacement, longitudinal movement, as well as twisting or turning of the horizontal arms.

Each of the depending legs is provided with a pair of oppositely directed trunions lying the plane of the handle. Engaged over the trunions is a mounting bracket, which is flexed about the trunions, thereby the bracket can be separately fabricated at low cost.

Full details of the present invention are set forth in the following description and are illustrated in the accompanying drawings.

BRIEF DESCRIPTION OF THE DRAWINGS

FIG. 1 is an isometric view of the handle assembly mounted upon a side panel of a piece of luggage such as an attache case;

FIG. 2 is an exploded isometric view of the handle shown in FIG. 1;

FIG. 3 is a side-elevational view, partially sectioned, showing the construction and assembly of the mounting brackets to the handle;

FIG. 4*a* is a sectional view taken along line 4—4 of FIG. 3 just before the handle is fully assembled into its interlocked position; and FIG. 4*b* is a similar view to that of FIG. 4*a* showing the handle fully assembled.

DESCRIPTION OF THE INVENTION

As seen in FIG. 1, the handle, generally depicted by the numeral 10 is shown pivotally attached by a pair of brackets, generally indicated by the numeral 12 to the mounting panel or frame of a piece of luggage, generally indicated by the numeral 14. As seen in FIG. 2, the handle 10 comprises a pair of identical monolithically molded plastic handle halves, generally depicted by the numeral 16; each handle half 16 having a depending leg 18 and a horizontal arm 20 extending at right angles to each other. The vertically depending leg 18 of each half is formed as a solid block having an enlarged boss 22 at its upper end from which the horizontal arm 20 extends. The horizontal arm 20 is more or less substantially flat and blade-like having an overall width of substantially half that of the vertical leg 18. The horizontal arm 20 extends from one side of the boss 22 of the vertically depending leg 18 which is also provided with a cavity 24 adjacent to and parallel to the horizontal arm 20. Since the handle halves 16 are molded, the cavity 24 can be easily formed by the mold core which when pulled from the mold leaves a taper within the cavity.

The outer longitudinal surface 26 of the horizontal arm 20 is depressed generally along most of its length, leaving enlarged ridges 28 and 30 at both its ends. The extreme tip 32 of the horizontal arm 20 is tapered, so that it fits easily and conformingly into the cavity 24 which as just explained, is itself tapered by the core pull itself. The inner surface 34 of the horizontal arm 20 is smooth, thereby permitting the arms to slide easily against each other. Located approximately midway between the ends of the horizontal arm 20, on the sliding or inner surface 34 is an indentation 36, and adJacent thereto a cammed wedged surface detent 38.

The lower ends of the vertically depending legs 18 are provided with a pair of oppositely directed trunions 40 lying in the plane of the handle. Attached to the pivot pin is a bracket 42 comprising a pair of post-like members 44, each having a recess 46 for receiving one of the trunions 40. The posts 44 are joined together by a base 48 which is flexible along a hinge line 50 running transversely to the direction of the trunions. The hinge line 50 is formed by forming a slight groove 52 (FIG. 3) on the undersurface of the base 48, thereby enabling the bracket to be flexed as indicated by the arrows A, i.e., by moving the posts apart simply by pinching the ends of the base. Thus the trunions 40 can be easily inserted in the post recesses. Once the trunions are inserted, the bracket 42 returns to its normal position securely holding the trunions 40. The bracket 42 is attachable to the luggage mounting or frame 14 by a rivet 54 (although expandable plugs, or screws, may be used) passing into an appropriate hole 56 (FIG. 3) in the post 44. Alternatively, base 48 can be made thin enough so that groove 52 can be omitted.

The handle 10 is completed by providing a central sleeve 58 adapted to snuugly fit surrounding the assembled horizontal arms. The sleeve 58 which has an inner cross section conforming basically to the overall cross section of the horizontal arms. As shown in the drawing, both the inner and the outer cross sections of the sleeve are rectangular in shape. Other shapes will, of course, be obvious. The sleeve may be embossed in a pseudo leather style, or it may take on any other desirable decorative aspect, that is, its color may be different than that of the handle halves and the plastic from which it is formed may also be different. The sleeve may indeed be made of metal, fiberglass, or any other product, although a simple molded or extruded tubular member is preferred.

As seen from FIGS. 2 and 4, the handle is easily assembled by arranging two identical handle halves 16 in opposition to each other and sliding the opposing horizontal arms 20 simultaneously through the sleeve 58, in abutment with each other until the respective tapered tips 32 enter into the cavities 24 respectively in the opposing vertically directed legs 18. Upon the sliding engagement, the cammed surfaces of the wedge detents 38, cause the horizontal arms to bow out laterally until the detents engage one over the other and each seats in the opposing indentation 36 (FIG. 4*b*). The tapered tips 32 once seated in the cavities 24 prevent the horizontal arms 20 from being longitudinally separated by exerting a lateral bias on the wedges 38. The sleeve also prevents the arms from twisting and turning when gripped by the user.

As will be obvious from the drawings, the assembly of two handle halves 16 creates a bridge connecting, by the horizontal arms, the opposing depending legs 18 which remain in interlocking engagement whether or not the outer sleeve 58 is employed. However, use of the outer sleeve insures that the lateral bias on the interlocking wedges 38 remains at all times even during heavy use. That is, once the arms 20 are interlocked within the sleeve, they will not disengage, nor can they be taken apart without destruction of either the sleeve or the interlocking wedges.

The sleeve 58 substantially surrounds the horizontal arms 20 and engages with the ridges 28 and 30 at the respective ends as well as frontally engaging the bosses 22 so that there is no play or movement between the sleeve and the handle halves. This enables the user to firmly grip the sleeve providing the sensation that the sleeve and handle halves are as a single unitary structure.

Once the handle halves 10 are assembled, the mounting brackets 42 may be applied over the trunions 40. Of course, if desired, the brackets 42 can be applied to the separate trunions before assembly of the handle halves. Because of the hinge-like construction of the base 48 of the bracket, the bracket is easily flexed manually, and applied to the trunions 40. The memory characteristic of bracket material insures that the bracket remains fast on the trunions during storage packaging and shipment. When the handle is mounted on the luggage panel 14, introduction and positioning of the rivets 54 in the holes 56 stiffens and strengthens the bracket so that it is no longer flexible thus resulting in a secure non-removable mount for the handle, relative to the luggage panel. The brackets are preferably formed of plastic material although these too may be of aluminum or other materials which, when provided with the hinge groove, can flex without breaking apart.

Various modifications, changes and embodiments have been suggested herein and others will be obvious to those skilled in the art. Accordingly, the present disclosure is not to be taken as being limiting of the scope of the invention.

What is claimed is:

1. A luggage handle comprising a pair of spaced apart identical handle halves consisting of two vertical legs each having a cavity formed in an upper end thereof in facing relation to the other cavity, a horizontal arm extending at a right angle from each said vertical leg in spanning relation between said handle halves with a free end of the horizontal arm of one said handle half projected into the cavity of the other handle half and said horizontal arms having abutting surfaces along their lengths in overlapping relation, each said horizontal arm surface having formed thereon a wedge and a recess at selected locations therealong such that said wedge of one arm seats in the recess of the other arm and said wedges are in an interengaged relation with each other, said free ends of said horizontal arms and said cavities having cooperating cam surfaces effective to cam said horizontal arms towards each other so as to maintain said interengaged condition of said wedges, and a hollow sleeve disposed in covering relation about said arms in said positions thereof spanning between said handle halves, whereby said sleeve and the ends of said horizontal arms projected in said cavities confine relative movement of said arms to a vertical plane in which said wedges are interengaged to thereby obviate any inadvertent disassembly of said handle halves.

2. The luggage handle according to claim 1 having means for pivotally attaching the legs of each of said handle halves to the luggage.

3. The luggage handle according to claim 2 wherein said attachment means comprises a pair of trunions extending from opposite edges of each of said legs within the plane of said handle, and a bracket attached to each pair of trunions, said bracket having a base and a pair of upstanding posts, each post having a recess therein for receiving a respective one of said trunions, said base being further flexible intermediate said trunions so that said posts may be spread apart to permit entry of said trunions within said recesses, and means for fixedly securing said bracket to a wall of said luggage and securing said base against flexing.

* * * * *